US006176575B1

(12) United States Patent
Crawford et al.

(10) Patent No.: US 6,176,575 B1
(45) Date of Patent: Jan. 23, 2001

(54) DRUM MAINTENANCE UNIT LIFE EXTENSION

(75) Inventors: Timothy L. Crawford, St. Paul; David W. Johnson, Tigard; Gerard H. Rousseau, Portland, all of OR (US)

(73) Assignee: Xerox Corporation, Stamford, CT (US)

( * ) Notice: Under 35 U.S.C. 154(b), the term of this patent shall be extended for 0 days.

(21) Appl. No.: 09/383,048

(22) Filed: Aug. 25, 1999

(51) Int. Cl.[7] ..... B41J 2/01

(52) U.S. Cl. ..... 347/103; 347/84; 347/88; 347/5

(58) Field of Search ..... 347/103, 104, 347/20, 36, 84, 85, 93, 95, 88, 5, 6; 399/324, 325

(56) References Cited

U.S. PATENT DOCUMENTS 5,099,256 * 3/1992 Anderson ..... 347/103
5,389,958 * 2/1995 Bui et al. ..... 347/103
5,805,191 9/1998 Jones et al. .
6,068,372 * 5/2000 Rousseau et al. ..... 347/103

* cited by examiner

*Primary Examiner*—John S. Hilten
*Assistant Examiner*—Minh H. Chau
(74) *Attorney, Agent, or Firm*—Francis I. Gray

(57) ABSTRACT

A scheme for extending the life of a drum maintenance unit that applies a release agent to the surface of a transfer drum in a phase change ink inkjet printer determines a release agent usage ratio based on an ink coverage percentage for each print. The release agent usage ratios for each print are accumulated, and each time the release agent ratio accumulation value has an integer change a maintenance counter in the drum maintenance unit is decremented by one from an initial nominal number of prints to produce a number of prints remaining. Once the number of prints remaining reaches a specified low value, the maintenance counter may be decremented by one for each additional print to allow for variability in the amount of release agent consumed per print from projected values. As a result depending upon a particular customer usage profile a drum maintenance unit having a nominal life of 30,000 prints, for example, may be extended by over 40%.

8 Claims, 3 Drawing Sheets

| ICP | RAC | RAUR | USE | PRINTS | COUNTS | USE | PRINTS | COUNTS | USE | PRINTS | COUNTS |
|---|---|---|---|---|---|---|---|---|---|---|---|
| 0 | 2.25 | 0.65 | 3 | 926 | 602 | 0 | 0 | 0 | 0 | 0 | 0 |
| 10 | 2.9 | 0.65 | 32 | 9877 | 6420 | 95 | 40400 | 26260 | 0 | 0 | 0 |
| 25 | 4.1 | 0.93 | 35 | 10803 | 10047 | 0 | 0 | 0 | 0 | 0 | 0 |
| 60 | 5.6 | 1.288 | 25 | 7717 | 9939 | 0 | 0 | 0 | 0 | 0 | 0 |
| 80 | 5.7 | 1.288 | 3 | 926 | 1193 | 5 | 2126 | 2739 | 100 | 22515 | 28999 |
| 100 | 5.7 | 1.288 | 2 | 617 | 795 | 0 | 0 | 0 | 0 | 0 | 0 |
| | | | 100 | 30867 | 28966 | 100 | 42256 | 28999 | 100 | 22515 | 28999 |
| | | | | 31867 | 29996 | | 43526 | 29999 | | 23515 | 29999 |
| | | | | C1 | | | C2 | | | C3 | |

FIG. 3

DRUM MAINTENANCE UNIT LIFE EXTENSION

BACKGROUND OF THE INVENTION

The present invention relates to phase change ink inkjet printers, and more particularly to the extension of the life of a drum maintenance unit used to deliver a release agent to a phase change ink inkjet printer transfer drum.

In solid phase change ink inkjet printers, where the ink is solid at room temperatures but is heated for ejection as a liquid onto an intermediate transfer surface, a drum maintenance unit is used as described in U.S. Pat. No. 5,805,191, incorporated herein by reference, to deliver a release agent, such as a silicone oil and/or functionalized oils, onto the intermediate transfer surface in order to allow an acceptable release of an image upon transfer from the intermediate transfer surface to media, such as paper or transparency. A certain amount of release agent is consumed for each simplex print so that the drum maintenance unit has to be replaced periodically when the release agent is fully consumed.

Currently the lifetime of the drum maintenance unit is specified according to a predetermined average release agent usage per print based upon a maximum customer usage profile, i.e., a usage profile that fits most customers. For example if the number of simplex prints specified for a particular drum maintenance unit is 30,000, then for each print the number is decremented in a memory or counter located in the drum maintenance unit until the number of copies reaches a low limit. At the low limit a message is provided on a display of the printer indicating to a user that the drum maintenance unit is in imminent need for replacement and a new unit should be ordered. When a very low limit is reached, the message produces an output indicating the remaining number of prints before the drum maintenance unit is depleted and needs to be replaced.

When the drum maintenance unit is replaced based upon the predetermined number of copies, there usually is still some release agent remaining in the drum maintenance unit reservoir that could be used to extend the life of the unit and produce more prints. Therefore what is desired is a scheme for extending the life of the drum maintenance unit by predicting more accurately the release agent usage without changing the hardware configuration of the drum maintenance unit.

BRIEF SUMMARY OF THE INVENTION

Accordingly the present invention provides a scheme for extending the life of a drum maintenance unit without changing the unit configuration by more accurately predicting release agent usage. Since the amount of release agent consumed for each print is proportional to the amount of ink used for each print, an ink coverage percentage is determined for each print based upon the image information contained in an image data file. The ink coverage percentage reflects the percentage of available print area that is covered by ink, which varies from full coverage to no coverage. From the ink coverage percentage a release agent usage ratio is determined based upon a release agent usage versus ink coverage percentage function. The release agent usage ratios for each print are accumulated in a virtual counter, and when the sum exceeds one, a counter in the drum maintenance unit is decremented and the fractional part is maintained in the virtual counter. When the number in the drum maintenance unit counter reaches a specified low value, the virtual counter may be disabled so that every print decrements the drum maintenance unit counter to assure that the release agent isn't depleted prematurely, allowing for variations in usage between drum maintenance units. In this way a nominal 30,000 print drum maintenance unit may be extended by over forty percent depending upon the average ink coverage for the particular customer usage profile.

The objects, advantages and other novel features of the present invention are apparent from the following detailed description when read in conjunction with the appended claims and attached drawing.

BRIEF DESCRIPTION OF THE SEVERAL VIEWS OF THE DRAWING

FIG. 3 illustrates the number of copies for a drum maintenance unit according to the present invention according to different customer usage profiles.

DETAILED DESCRIPTION OF THE INVENTION

Figure 1:
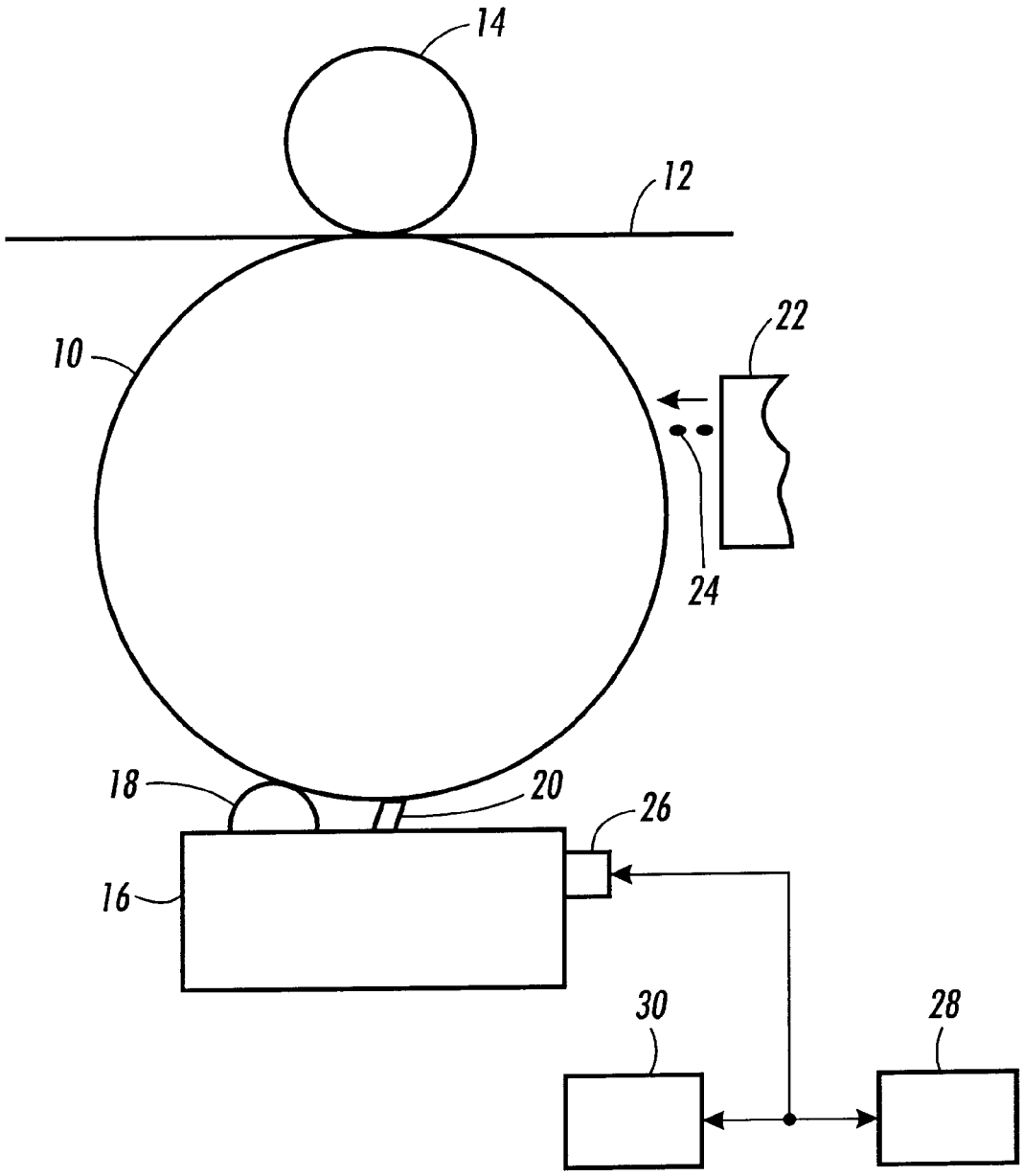
FIG. 1 is a simplified illustrative view of a portion of a phase change ink inkjet printer having an extended life drum maintenance unit according to the present invention.

Referring now to FIG. 1 a transfer drum 10 is shown for transferring an image from the drum to media 12, such as paper or transparency, at a nip formed with a transfix roller 14. A drum maintenance unit 16 is shown having a roller 18 or the like for applying release agent to the transfer drum surface and a blade 20 for metering the release agent to a thin film. An inkjet head 22 also is shown that ejects phase change ink 24 in its molten state onto the surface of the transfer drum 10 once the drum is coated with the release agent. The drum maintenance IQ unit 16 also includes a maintenance counter 26, which may be a memory or counter, for keeping track of the number of prints (simplex) made to determine when the drum maintenance unit needs to be replaced. The memory or counter 26 is electrically coupled to a user interface 28 and a control unit 30 external to the drum maintenance unit 16.

Figure 2:
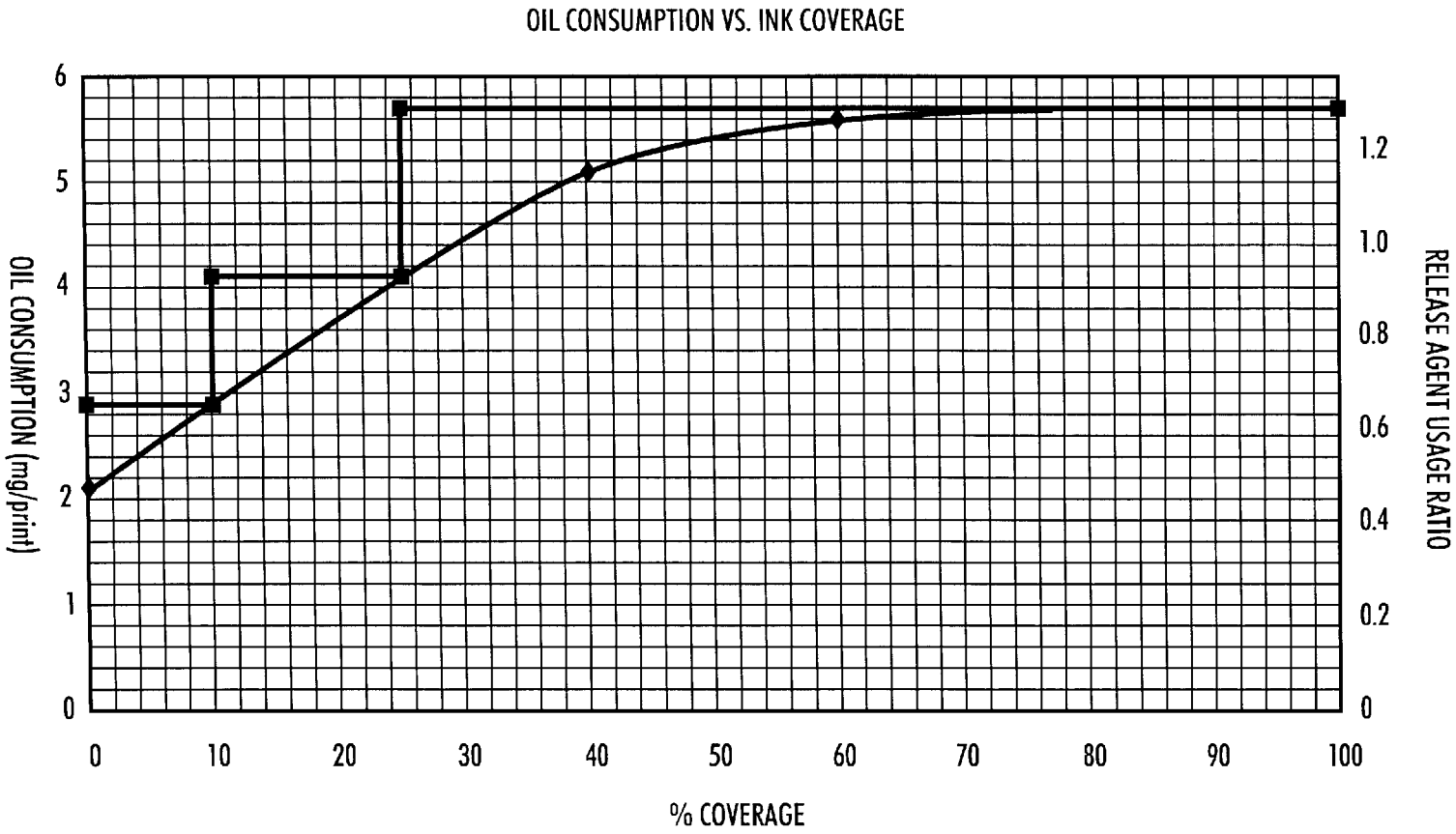
FIG. 2 is a graphic view of release agent usage per print versus ink coverage percentage according to the present invention.

The amount of release agent consumed is not constant for each print, but varies as a function of the amount of ink that is used. An ink coverage percentage (ICP) is determined as a ratio of the number of "pixels" to be covered to the total available number of pixels of the print. As shown in FIG. 2 the greater the percentage of the available area to be covered by ink for any given 20 print, the more release agent that is consumed. Testing for a particular printer shows that a solid fill image (worst case) may consume almost 6 milligrams of release agent whereas a blank image with no ink may consume only about 2 milligrams. A release agent usage ratio (RAUR) is determined based upon the release agent consumption versus ink coverage percentage function. Therefore the actual release agent consumed may be reasonably estimated on a print by print basis from the release agent usage ratio for each print.

The image to be printed is transferred to the printer in the form of an image data file, such as an Adobe Postscript file. From the image data file the pixels to be covered with ink may be determined and compared with the total available print area to determine the ink coverage percentage. The ink coverage percentage is then converted to the release agent usage ratio, which may be obtained from a lookup table representing the release agent usage/ink coverage percentage relationship. For each print a virtual counter in the control unit keeps a running total of the fractional portions of the release agent usage ratios for each print. For each overflow, or integer change, in the virtual counter the control unit decrements the count in the maintenance counter by one. In this way the predetermined number of copies remains unchanged in the maintenance counter, as well as the low and very low comparison counts. However the maintenance counter does not reflect the total number of copies actually printed, or actually remaining to be printed. The control unit may provide to the interface a percentage release agent remaining instead of the number of copies remaining.

When the very low number is reached, such as 1,000 copies, the algorithm for the release agent ratio may be terminated so that for the last 1000 copies the maintenance counter is decremented by one for each print as was done previously.

Referring now to FIG. 3 different customer usage profiles C1, C2 and C3 are shown with the different amounts of release agent consumed for each profile. For each ink coverage percentage (ICP) a release agent consumption (RAC) is shown in milligrams as well as a corresponding release agent usage ratio (RAUR). The customer usage profiles show the percentage of prints produced at various ink coverage percentages, and the average release agent weight for the profile attributed to that percentage. Based upon a total release agent weight of 130 grams for this example, the lifetime for the drum maintenance unit is shown for each of the customer profiles. As shown assuming a "nominal" 30,000 copy drum maintenance unit based upon either oil consumption or percent coverage of images printed, for different profiles the number of actual prints that may be obtained by extending the life as indicated above may vary up to over 40% above the 30,000 copy nominal lifetime to less than the 30,000 copy nominal lifetime in worst case situations. For example for customer profile C1 three percent of the prints are blank, resulting in 932 prints and a count of 602, whereas 35% of the prints have 25% coverage, resulting in 10,803 prints and a count of 10,047. The total number of prints are shown less 1000 as 30,867 for a count of 28,996. The algorithm is turned off for the last 1000 prints, resulting in a total of 31,867. Customer profile C2 produces over 43,000 prints, while customer profile C3 produces less than 24,000 prints.

As a practical matter the range of ink coverage percentages may be subdivided into a finite number of bins as shown in FIG. 2, such as <10%, 10– 25% and >25%, and a particular release agent usage ratio (RUAR), such as 0.65, 0.93 and 1.288 respectively, may be provided for each bin. Only at the interface between successive bins would the decrement value be accurate for the lower range bin according to the release agent consumption/ink coverage percentage function, but this insures that variations in the amount of release agent consumed per print are allowed for, especially when more release agent is consumed per print than projected by the algorithm.

Although the above description refers to decrementing the maintenance counter from an initial nominal lifetime value, the maintenance counter may be incremented from zero up to a nominal lifetime value and the values used for alerting the user of imminent depletion and then of depletion may be related to such nominal lifetime value. The significant feature is that the maintenance counter is stepped for each integer change of the accumulated release agent usage ratios.

Thus the present invention provides a scheme for extending the life of a drum maintenance unit of a phase change ink inkjet printer by determining a release agent usage ratio based on a calculated ink coverage percentage for each print, and decrementing a maintenance counter in the drum maintenance unit each time the accumulation of release agent usage ratios produces an integer value change.

What is claimed is:

1. A method of extending the life of a drum maintenance unit that provides a release agent to the surface of a transfer print drum in a phase change ink inkjet printer comprising the steps of:

determining from an image data file for each print an ink coverage percentage;

determining a release agent usage ratio from the ink coverage percentage;

accumulating the release agent usage ratios for each print in a virtual counter; and stepping a maintenance counter in the drum maintenance unit by one each time the virtual counter produces an integer change.

2. The method as recited in claim 1 wherein the ink coverage percentage determining step comprises the steps of:

extracting from the image data file a number of image pixels to be covered with ink; and dividing the result of the extracting step by the number of available pixels for printing to produce the ink coverage percentage.

3. The method as recited in claim 2 wherein the release agent usage ratio determining step comprises the steps of:

calculating a release agent consumption value from a predetermined release agent consumption/ink coverage percentage function according to the determined ink coverage percentage; and converting the release agent consumption value to the release agent usage ratio according to a predetermined release agent consumption/release agent usage ratio function.

4. The method as recited in claim 2 wherein the release agent usage ratio determining step comprises the steps of:

providing a plurality of ink coverage percentage bins; and assigning a specified release agent usage ratio for each ink coverage percentage bin so that the release agent usage ratio is determined by the bin within which the ink coverage percentage falls.

5. The method as recited in claims 1, 2, 3 or 4 further comprising the step of stepping the maintenance counter by one for each print after the value in the maintenance counter reaches a specified value.

6. The method as recited in claim 5 further comprising the step of displaying a warning message on a display indicating an imminent depletion of release agent in the drum maintenance unit when the value in the maintenance counter reaches the specified value.

7. The method as recited in claim 5 further comprising the step of indicating to a user that the drum maintenance unit needs to be replaced when the value in the maintenance counter reaches a depletion value.

8. The method as recited in claims 1, 2, 3 or 4 further comprising the step of generating a percentage of release agent remaining in the drum maintenance unit for display upon demand.

* * * * *